US006547209B1

(12) United States Patent
Vappula

(10) Patent No.: US 6,547,209 B1
(45) **Date of Patent: *Apr. 15, 2003**

(54) REMOVABLE SIDE SYSTEM FOR A CONCRETE MOULD

(75) Inventor: Kari Vappula, Toijala (FI)

(73) Assignee: Addtek Research & Development Oy Ab, Vantaa (FI)

( * ) Notice: Subject to any disclaimer, the term of this patent is extended or adjusted under 35 U.S.C. 154(b) by 31 days.

This patent is subject to a terminal disclaimer.

(21) Appl. No.: 09/633,097

(22) Filed: Aug. 4, 2000

(30) Foreign Application Priority Data

Aug. 9, 1999 (FI) ..... 990339 U

(51) Int. Cl.[7] ..... B28B 7/00

(52) U.S. Cl. ..... 249/139; 249/163; 249/168; 249/187.1; 425/DIG. 33

(58) Field of Search ..... 249/139, 160, 249/163, 168, 187.1; 425/3, DIG. 33

(56) References Cited

U.S. PATENT DOCUMENTS 1,431,635 A * 10/1922 Conroy ..... 249/134
3,667,880 A * 6/1972 Malet et al. ..... 425/3
6,082,701 A * 7/2000 Reymann ..... 249/160
6,202,978 B1 * 3/2001 Vappula ..... 249/187.1
6,276,657 B1 * 8/2001 Vappula ..... 249/163

FOREIGN PATENT DOCUMENTS

| | | |
|---|---|---|
| DE | 29 07 508 | 9/1980 |
| EP | 0 945 237 | 9/1999 |
| FR | 2552145 | 3/1985 |

* cited by examiner

*Primary Examiner*—Jan H. Silbaugh
*Assistant Examiner*—Donald Heckenberg
(74) *Attorney, Agent, or Firm*—Burns, Doane, Swecker & Mathis, L.L.P.

(57) ABSTRACT

A mold side system for a concrete mold, including one or more mold side parts to be removably attached to a casting bed by one or more magnet units. The magnet unit has a front face to be supported against the back face of the mold side part, which front face includes an oblique projecting member to be placed in an oblique counter-groove or hole provided in the back face of the mold side to thereby press the front face and the back face together when the magnet unit is attached to the casting bed.

11 Claims, 6 Drawing Sheets

REMOVABLE SIDE SYSTEM FOR A CONCRETE MOULD

TECHNICAL FIELD

This invention relates to a concrete mould side system comprising a side part that can be removably attached to a casting bed by means of one or more magnets.

PRIOR ART

Removable mould sides that are provided with different kinds of fastener solutions and designed for a concrete mould for casting elements from concrete have been disclosed in the prior art. These sides can be placed in desired positions on the casting bed depending on the size and shape of the object to be cast.

When wall elements are cast from concrete, the horizontal mould is usually a table mould, i.e. a tiltable mould with sides. A concrete dispenser moves above the table and allows a defined amount of mass to flow into the mould. Once the concrete is hardened, the table is tipped about a tilting axis provided on one side, into an almost upright position. The mould side that ends up in the upper position is removed, and the element is lifted away from the table using rings provided on its sides. The position of the upper side has to be adjustable according to the size of the element to be cast. Removable mould sides can be used for this purpose.

In addition, removable and adjustable mould side units enable door or window openings to be made at desired locations in the element.

The use of magnets for fastening removable mould sides is well known in the art. They are very suitable for fastening a mould side as they attach themselves to the flat steel surface of the casting bed. In order to secure a firm attachment of the mould side, strong magnets generating an attractive force of e.g. 15 kN must be used. In European patent application no. 99660050.8, a magnetic mould side fastening system is disclosed, wherein the frame of the magnet-carrying unit comprises a tilting axis about which the magnet unit can be tilted into a lower position, in which the magnet is contact with the casting bed, and into an upper position in which the magnet is not in contact with the casting bed. The mould side unit comprises a support on which the tilting axle of the magnet unit can be thus supported, that the unit is movable between a lower and an upper position, and the support has a gripping surface to which the upper surface of the magnet can be attached by means of attraction force when the magnet is tilted into its upper position about its tilting axle. The magnet is detached from the bed by means of a double acting lever.

SUMMARY OF THE INVENTION

This invention concerns a concrete mould side system comprising one or more mould side parts removably attached to a casting bed by means of one or more magnet units, wherein the magnet unit has a front face to be supported against the back face of the mould side part. The front face includes an oblique projecting member to be placed in an oblique counter-groove or hole provided in the back face of the mould side to press said front face and said back face together when the magnet unit is attached to the casting bed. The invention provides a system for fastening a magnet to a mould side, which system is simpler and more versatile than those previously known. A separate magnet unit comprises a tiltable permanent magnet. The magnet unit is fastened to a counterpart provided on the mould side by means of an oblique projecting member provided on its front face, engaging a corresponding groove in the counterpart. The front face of the magnet unit is designed to set at an angle of exactly 90° to the casting bed when the magnet unit is fastened to the mould side, the front face of the magnet unit biting into the back face of the mould side due to the characteristic wedging groove action, and keeping the side upright all the time. In its fastened position, the magnet unit is always supported by the bottom surface of its rear end and by the side profile, since the bottom surface of the front end of the magnet is not in contact with the casting bed when the magnet is fastened to the mould side. Relative to the counter-groove in the mould side, the projecting member of the magnet unit can be directly complementary in shape, or it can be an oblique pin or tongue penetrating into an oblique hole, a saw-cut or the like forming the counter-groove.

The system according to the invention affects the mould side by the most direct vertical pressing force possible without using long levers. The internal forces of the system render the contact surface between the side and the magnet unit absolutely steady. The joint between the mould side and the casting bed is sealed at its front edge, and the mould side is prevented from falling backwards. The fastening is an easy and quick process, and the magnet can be coupled to any location on the mould side. This way of fastening makes it possible to place the mould side in the correct position without restrictions, and to release the fastening magnet without moving the mould side.

The system according to the invention may comprise a ready-to-use side profile having a running counter-groove for the magnet unit's gripping member on its back face. The profile may be sold by the meter and can be cut into desired lengths. It can be made from steel, or for instance from extruded light alloy. The profile may form a mould side as such, or it may be provided with a front face of plywood, in one piece or divided into sections. Since the mould side comprises the guiding counter-groove, different kinds of openings, such as window and door openings, can easily be created therefrom by means of braces. Instead of having a continuous profile, the mould side can be provided with local, shorter oblique counter-grooves.

An important property of the magnet unit according to the invention is that it can be located at the joints between mould side units, where it not only attaches the side units to the bed but also joins them together. Using suitable fastening fittings, angle joints can also be formed.

In addition to the groove joint, the magnet unit can be fastened to the mould side unit with screws. Both the magnet unit's front face and the upper surface perpendicular thereto are preferably provided with threaded holes. These fastening provisions make any local applications possible.

In the system according to the invention, readily available side and magnet parts can be used ex stock. The required equipment is thus easy to produce by combining standard parts. Moreover, the solution meets current requirements of ergonomics and automation (it is light and easy to clean, surfaces are even, robotics is applicable). The system also suits mould sides for products having openings, for all current product thicknesses manufactured in the concrete industry.

BRIEF DESCRIPTION OF THE DRAWINGS

The invention and the details thereof will be described in more detail in the following with reference to the accompanying drawings, wherein.

DISCLOSURE OF THE INVENTION

Preferably, the mould side is made from high tensile steel. It can also be made from extruded aluminum, light metal, plastic or the like. The construction enables light and durable designs, and designs which as a whole are as narrow as possible. The shape of the side enables the use of robotics in transport and storage of the mould sides.

Figure 1:
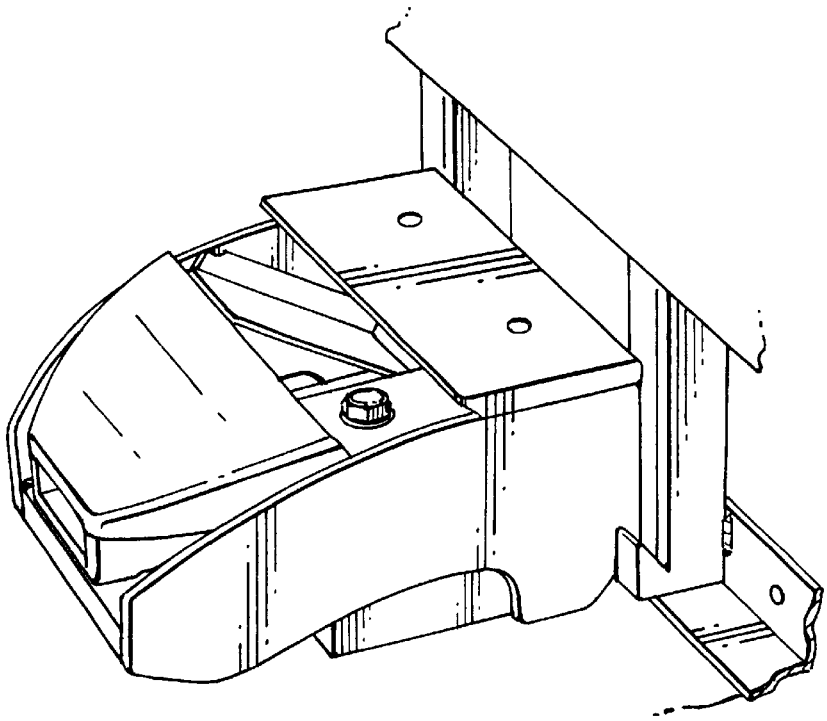
FIG. 1 is a perspective view of a magnet unit according to the invention, fastened to a mould side with the magnet attached to the casting bed.
Figure 2:
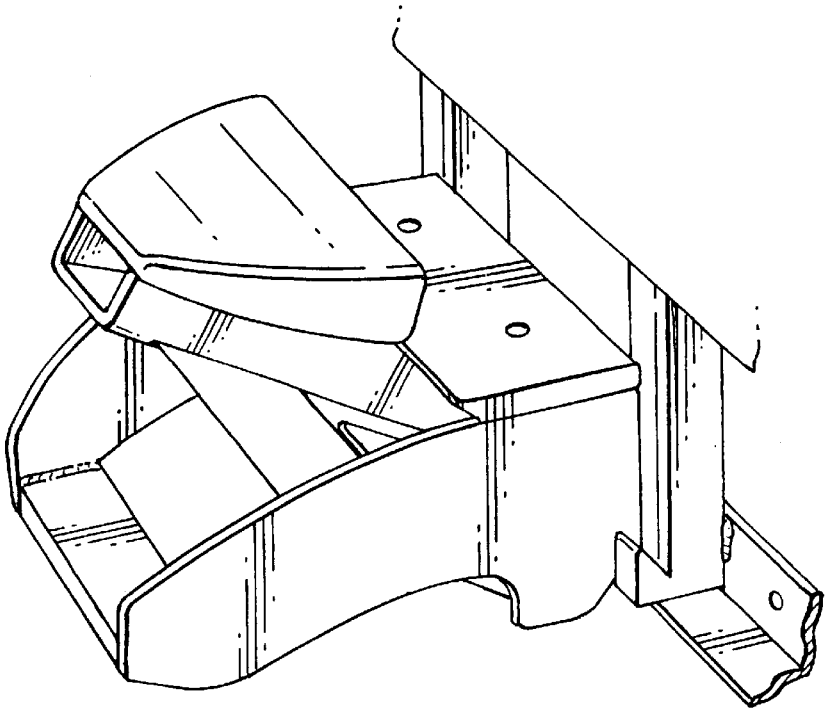
FIG. 2 shows the magnet unit and mould side as in FIG. 1 but with the magnet detached from the casting bed.

FIG. 1 shows the magnet unit according to the invention fastened to a mould side and with the magnet attached to the casting bed. FIG. 2 shows the same parts with the magnet in a released position. In the embodiment shown in the above mentioned Figures, narrow claws arranged in vertical steel bars of the mould side are used instead of a continuous counter-groove profile.

The lever system for attaching the magnet to the casting bed and for detaching it therefrom is disclosed in European patent application no. 996600500.8

Figure 3:
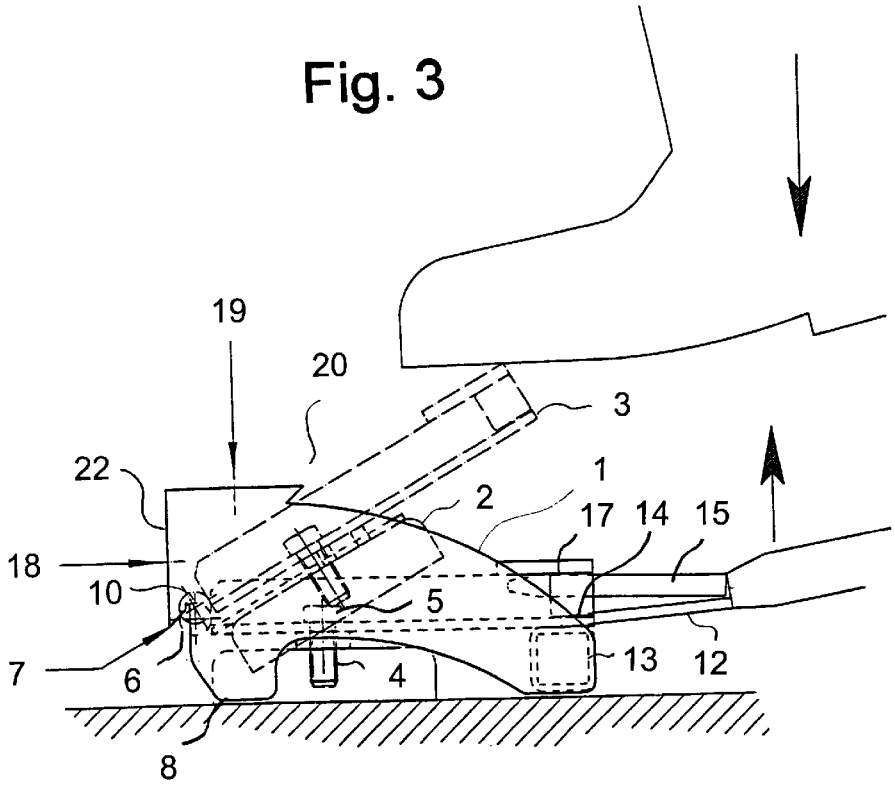
FIG. 3 is a side view of a magnet unit according to the invention, showing attached and detached positions of the magnet.

Referring to FIG. 3, the magnet unit 20 has a frame 1 and a tiltable part 3 comprising a permanent magnet 2. The permanent magnet is fastened to the tiltable part by an adjustable screw 5, which screw is secured within a protecting bushing 4 and enables vertical adjustment of the magnet in order to ensure good alignment and a tight fit at all locations relative to the mould side.

In FIG. 3, as well as in FIGS. 4 to 8 and 10*b*, the magnet is shown in both attached and detached positions. The tiltable part is shown attached to the casting bed and detached therefrom by continuous and broken lines, respectively. The magnet unit is fastened to the mould side by pushing the projecting member 7 of the oblique groove 6 of the front face 22 into a counter-groove provided in the mould side. The front end of the magnet unit is now supported by the groove joint, the bottom surface 8 of the magnet unit's front end being out of contact with the casting bed.

Once the mould side 9 (FIG. 4) is placed in a desired position on the casting bed, it is locked in place (FIG. 3) by lightly pressing the tiltable part 3 by the foot, so that the tiltable part tilts downwards about the axle 10 and the magnet engages the casting bed. The frame 1 of the magnet unit presses the oblique counter-groove 11 (FIG. 4) downwards, and forces the mould side tightly against the casting bed.

The magnet is detached from the bed by bearing down on a release lever (FIG. 3). The outer, lower branches 12 of the lever are pushed between frame 13 of body 1 and the tiltable part, under the lower release surfaces 14. The middlemost, upper branch 15 is pushed into a cavity provided in the tiltable part, below the upper release surface 17. The magnet can be detached from the bed by means of the outer branches, by pressing the bar of the release lever downwards. Only a small leverage is required to accomplish this. Subsequently, the bar of the release lever is lifted, as a result of which the middlemost branch of the lever rests firmly in the cavity and the magnet tilts upwards and engages body 1.

The weight of the magnet unit is moderate, and it is easy to handle and adjust. The entire attraction force of the magnet, which may be in the order of 14 kN, is optimized to keep the mould side against the casting bed.

The front face and upper surface of frame 1 may comprise threaded holes 18 and 19 for screwjoints.

Figure 4:
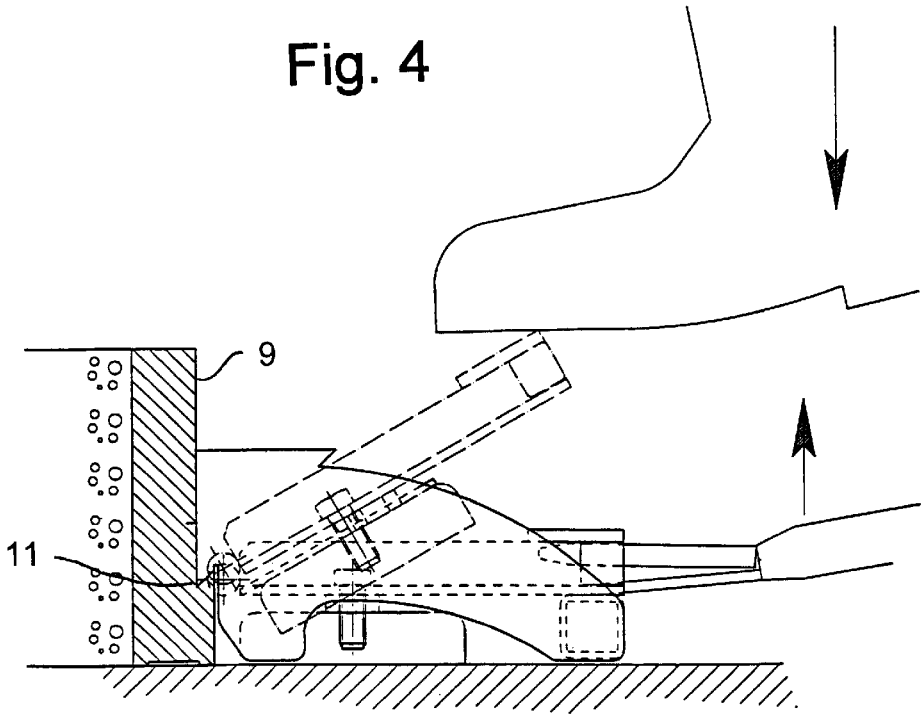
FIGS. 4 to 8 show the magnet unit according to the invention used with different types of mould side structures.
Figure 5:
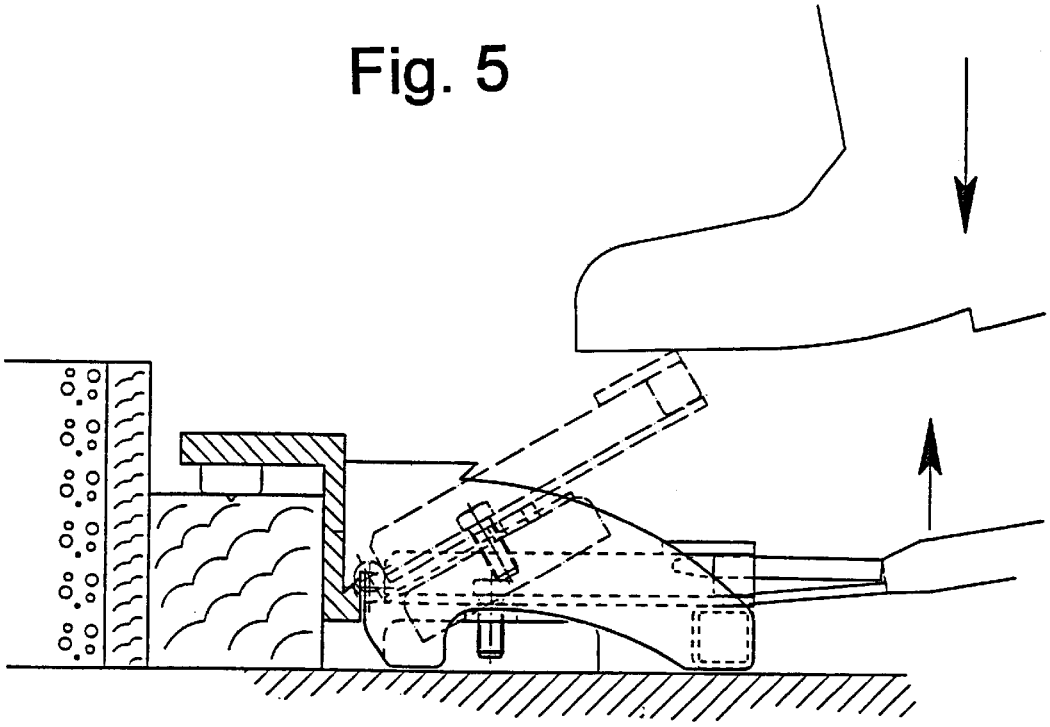
Figure 6:
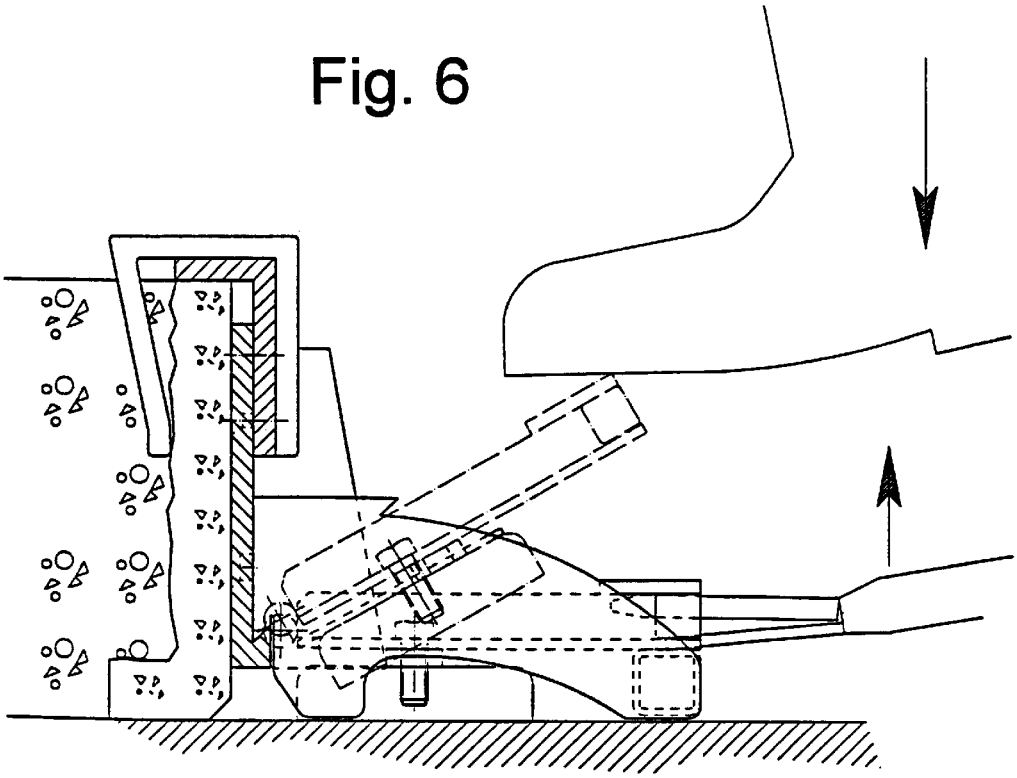
Figure 7:
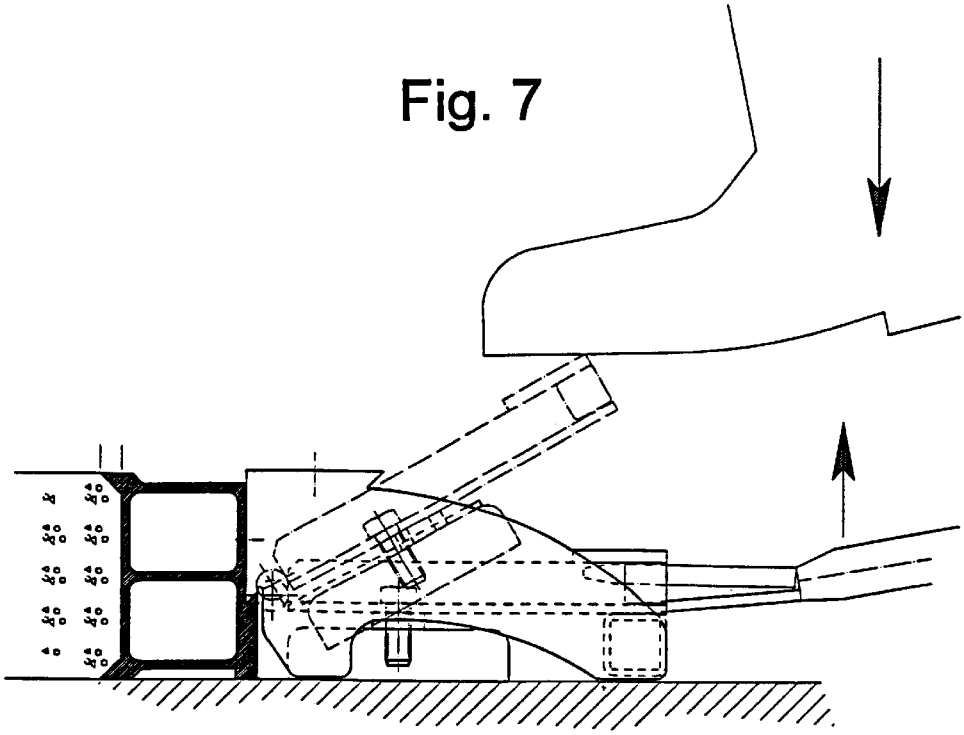
Figure 8:
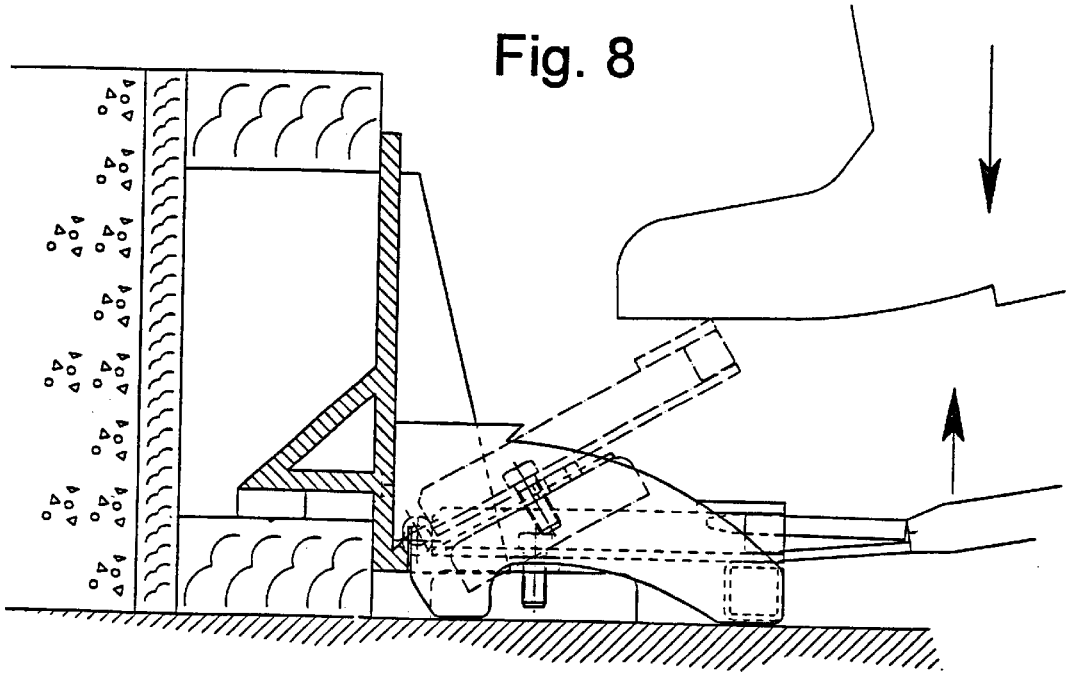

FIG. 4 is a cross-sectional side view of the magnet unit according to the invention, fastened to mould side 9. FIGS. 5 to 8 show other embodiments of the mould side according to the invention, wherein the structure and material of the mould vary, as will be understood by those skilled in the art. However, all the embodiments shown comprise a magnet unit counter-groove according to the present invention.

Figure 9:
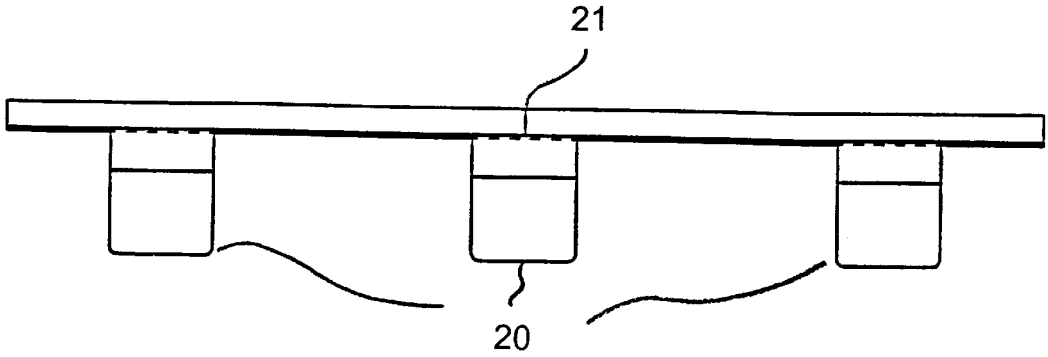
FIG. 9 is a top view showing how a magnet unit according to the invention can be used for joining mould side units together in a straight line.

FIG. 9 shows how the system according to the invention can be applied at a straight mould side extension. The magnet unit 20 is thus located, that the wedging members on the front face of the magnet unit engage the mould side counter-grooves of the side units on both sides of joint 21.

Figure 10A:
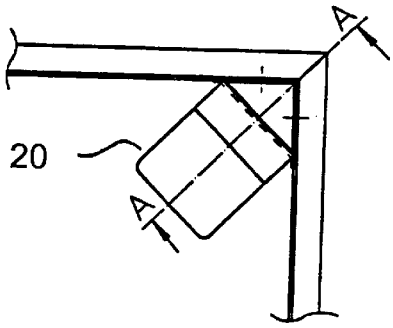
FIGS. 10*a* and 10*b* show how the system according to the invention can be used at an angle joint.
Figure 10B:
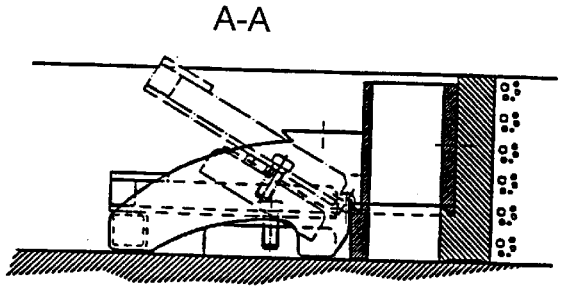

FIGS. 10*a* and 10*b* show how mould side units positioned at an angle respective to each other can be joined together by means of a corner profile adapter unit, which in turn is fastened to the casting bed using a magnet unit according to the present invention.

Figure 11:
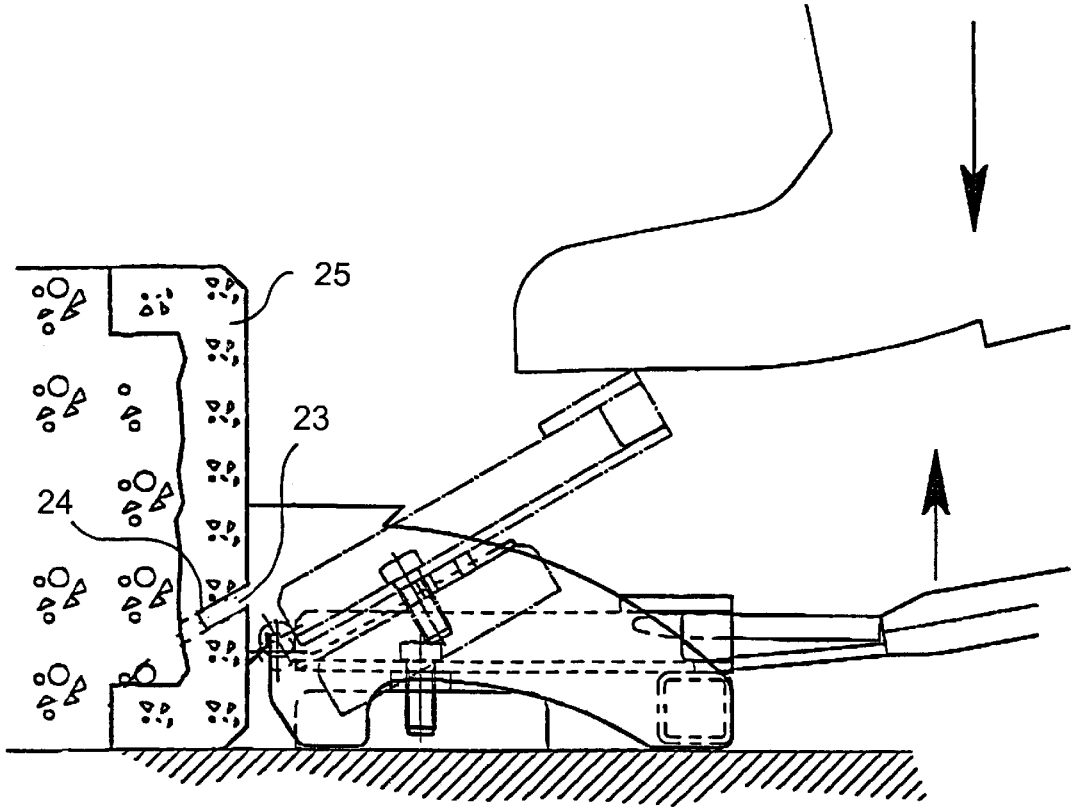
FIG. 11 shows an embodiment wherein the projecting part of the magnet is a pin that can be pushed into an oblique hole provided in the mould side.

In the embodiment shown in FIG. 11, the projecting part of the magnet unit consists of at least one oblique pin 23 that penetrates into an oblique hole (or holes, respectively) 24 provided in the mould side, generating a downward force for the mould, as a result of which the magnet's wedging pair of forces acts to straighten the front face of the mould side into an exactly perpendicular position. This embodiment is particularly useful for ready-to-use element mould sides made from fine-grained, fiber-reinforced concrete mix, so-called fiber sides 25, or e.g. for plain mould sides made from plywood. The required oblique holes can be drilled in the mould side with the aid of a guide tool at the cutting stage, or on the casting bed following mould assembly. Tongue-shaped protrusions and saw-cuts can also be used.

In the claims:

1. A mould side system for a concrete mould, comprising one or more mould side parts to be removably attached to a casting bed by means of one or more magnet units, wherein the magnet unit has a front face to be supported against the back face of the mould side part, which front face comprises an oblique projecting member to be placed in an oblique counter-groove or hole provided in the back face of the mould side part, whereby the magnet unit creates a wedging effect which presses said front face and said back face together as the magnet unit engages the casting bed.

2. A mould side system according to claim 1, wherein the magnet unit comprises a magnet and a tiltable magnet part supported by an axis and movable between a first and a second position, the magnet being attached to the casting bed in the first position and detached from the casting bed in the second position.

3. A mould side system as defined in claim 2, further comprising a release lever, wherein the magnet part has at least two stop faces at different elevations, and the release lever has at least two branches of which at least one can be pushed under the lower stop face(s), and of which the other(s) can be pushed under the upper stop face(s), the release lever being turnable around an axis parallel to the mould side.

4. A mould side system as defined in claim 1, wherein the oblique counter-groove or hole runs continuously over the entire back face of the mould side part.

5. A mould side system as defined in preceding claim 1, wherein the magnet unit can be positioned at a joint between two mould side parts, engaging both mould side parts.

6. A mould side system as defined in claim 2, wherein the magnet unit can be positioned at a joint between two mould side parts, engaging both mould side parts.

7. A mould side system as defined in claim 3, wherein the magnet unit can be positioned at a joint between two mould side parts, engaging both mould side parts.

8. A mould side system as defined in claim 4, wherein the magnet unit can be positioned at a joint between two mould side parts, engaging both mould side parts.

9. A mould side system as defined in claim 5, wherein the magnet unit can be positioned at a joint between two mould side parts, engaging both mould side parts.

10. A mould side system according to claim 1, wherein the magnet unit has a bottom surface, said bottom surface being out of contact with the casting bed when the oblique projecting member is engaged by the oblique counter-groove or hole.

11. A mould side system according to claim 1, wherein the oblique counter-groove or hole comprises a wedging groove or hole.

* * * * *